United States Patent [19]

Herold et al.

[11] Patent Number: 5,076,167

[45] Date of Patent: Dec. 31, 1991

[54] ARRANGEMENT FOR THE PARALLEL TENSIONING OF PRINTING PLATES

[75] Inventors: Manfred Herold, Kahl/Main; Herbert Rebel, Rodgau, both of Fed. Rep. of Germany

[73] Assignee: MAN Roland Druckmaschinen AG, Fed. Rep. of Germany

[21] Appl. No.: 606,430

[22] Filed: Oct. 31, 1990

[30] Foreign Application Priority Data

Nov. 2, 1989 [DE] Fed. Rep. of Germany ..... 3936459

[51] Int. Cl.[5] ..... B41F 1/28; B41F 21/00

[52] U.S. Cl. ..... 101/415.1; 51/364; 51/367; 51/368; 51/370; 101/378

[58] Field of Search ..... 101/415.1, 379, 378, 101/408, DIG. 36; 51/364, 367, 368, 370

[56] References Cited

U.S. PATENT DOCUMENTS 4,712,476 12/1987 Jeschke ..... 101/415.1

4,831,931 5/1989 Jeschke et al. ..... 101/415.1

FOREIGN PATENT DOCUMENTS

2501511C2 6/1988 Fed. Rep. of Germany .

3516682C2 6/1988 Fed. Rep. of Germany ... 101/415.1

3731684A1 4/1989 Fed. Rep. of Germany .

*Primary Examiner*—David A. Wiecking

*Assistant Examiner*—Moshe I. Cohen

*Attorney, Agent, or Firm*—Leydig, Voit & Mayer

[57] ABSTRACT

In order that the tension, particularly of large printing plates, and their automatic retensioning, may be regulated uniformly over the entire width without having an adverse effect on the final tensioning by means of tensioning screws (11), a tensioning lever (15, 16) is associated with each tensioning screw and is pivotally connected to a divided rear tensioning bar (4). The tensioning levers bear via lugs (17) on a pressure strip (9) movable in the cylinder gap, there being springs (12) acting on the free ends of the levers.

6 Claims, 5 Drawing Sheets

A
B

ARRANGEMENT FOR THE PARALLEL TENSIONING OF PRINTING PLATES

BACKGROUND OF THE INVENTION

This invention relates to an arrangement for the parallel tensioning of printing plates on a plate cylinder.

More specifically, the invention relates to a tensioning arrangement for use in a printing machine of the type in which the plate cylinder is disposed in a cylinder gap having a front wall. In an arrangement of this type, the ends of the printing plates are adapted to be clamped to a divided front tensioning bar and to a divided rear tensioning bar, the bars being located in the cylinder gap and being movable substantially in the circumferential direction of the cylinder in order to tension the plates.

Axially spaced front tensioning screws are connected to the front bar and bear directly against the front wall of the gap. Adjustment of the front screws results in substantially circumferential movement of the front tensioning bar.

Means are provided for effecting quick-action tensioning of the printing plates by moving the rear tensioning bar circumferentially. These means comprise a quick-acting mechanism for initial tensioning and further comprise rear tensioning screws for final tensioning. The quick-acting mechanism comprises a pressure strip extending axially along the cylinder gap. The pressure strip is formed with recesses having inclined surfaces which coact with axially fixed members having wedge surfaces. A central actuator is adapted to move the pressure strip axially back and forth and, when the strip is moved axially in one direction, the wedge surfaces act against the inclined surfaces of the recesses to move the rear tensioning bar circumferentially in one direction for initial tensioning of the printing plates.

The rear tensioning screws are connected to the rear tensioning bar and bear against the pressure strip. Adjustment of the rear screws results in substantially circumferential movement of the rear bar to effect final tensioning of the printing plates.

An arrangement of this kind is disclosed in West German Patent Specification 3,516,682 and serves to enable printing plates to be tensioned in parallel with a defined tensioning force. This achieves accurate register and, in the final tensioning, the known facilities for correcting the print employing a divided tensioning bar and associated tensioning screws may be retained. It is difficult to manufacture and assemble the constructional components with such accuracy that the rear divided tensioning bar is moved exactly parallel to the front gap wall. Overloading of the printing plate is quite possible. Automatic retensioning during machine operation is impossible.

SUMMARY OF THE INVENTION

The general object of the invention is to improve an arrangement of the above general type so as to allow regulation of the tension of the printing plates and their automatic re-tensioning uniformly over the entire width, particularly in the case of large-format printing machines.

A more detailed object of the invention is to achieve the foregoing through the provision of tensioning levers associated with the rear tensioning screws and operable to apply a biasing force to the pressure strip.

The invention also resides in the provision of unique thrust members for the spindle of the central actuator, the thrust members being adapted to be re-positioned in order to expand the tensioning range and effect uniform tensioning of printing plates of different lengths.

These and other objects and advantages of the invention will become more apparent from the following detailed description when taken in conjunction with the accompanying drawings.

DETAILED DESCRIPTION OF THE PREFERRED EMBODIMENT

Figures 1, 2:
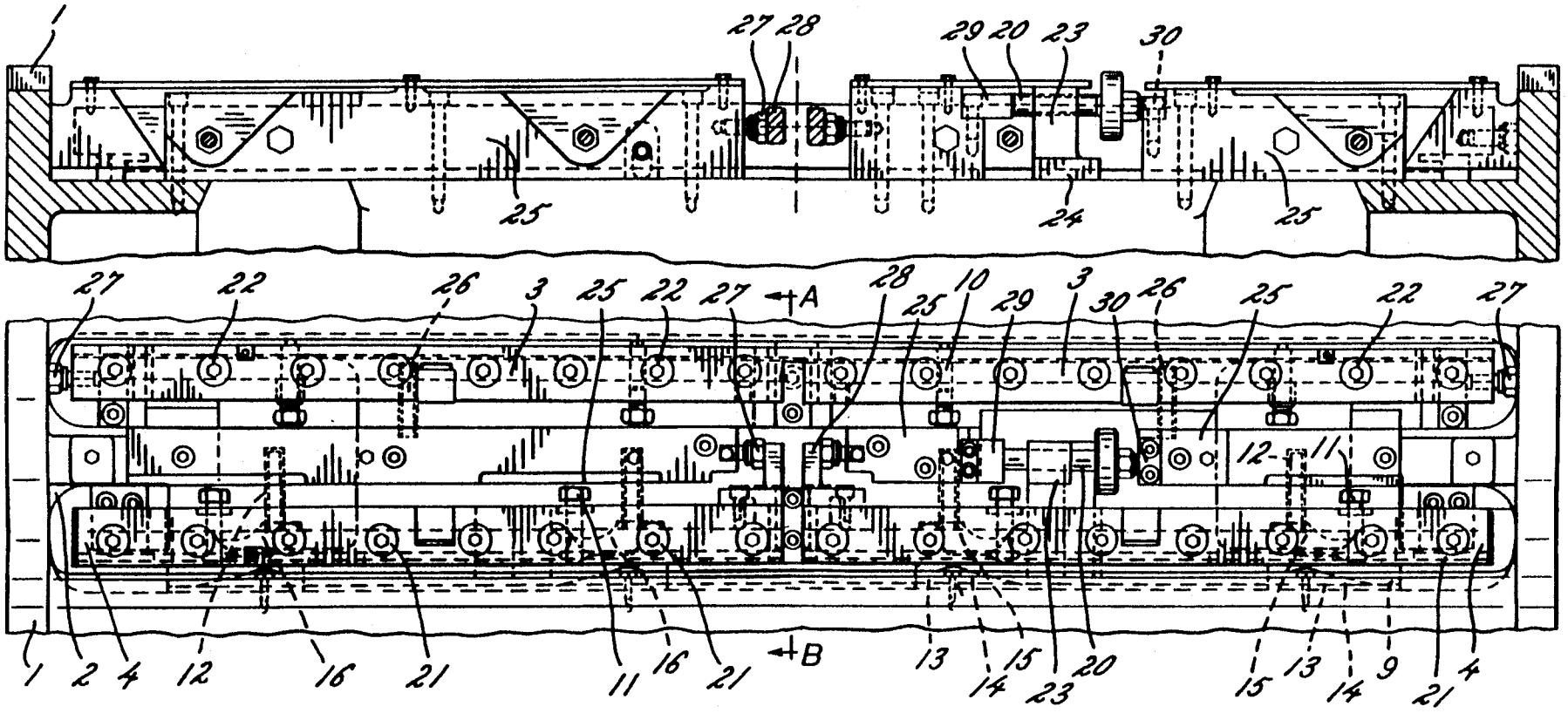
FIG. 1 is a fragmentary plan view of the plate cylinder side and showing the gap.
FIG. 2 is a fragmentary longitudinal section through the plate cylinder shown in FIG. 1.
Figure 3:
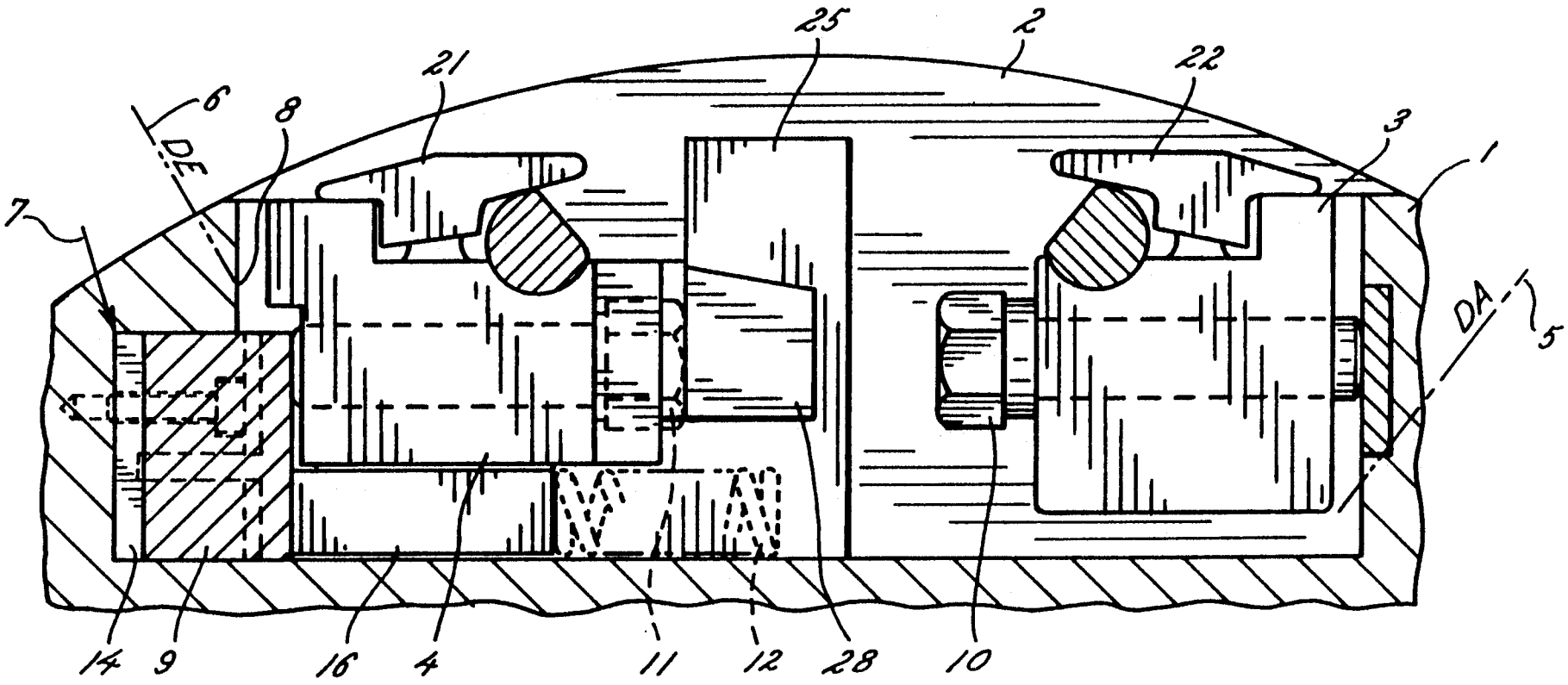
FIG. 3 is an enlarged simplified section taken along the line A–B of FIG. 1.

Referring to FIG. 1, the plate cylinder 1 of a printing machine has means for fixing and tensioning printing plates in a cylinder gap 2. These fixing means as shown in FIGS. 1 and 3 are in the form of a front tensioning bar 3 divided over the length of the plate cylinder 1 and a correspondingly divided rear tensioning bar 4. The tensioning bars 3 and 4 are disposed respectively at the print start 5 (FIG. 3) and at the print end 6 of the cylinder gap 2. The divided tensioning bars 3, 4 are disposed in known manner in the cylinder gap 2 and are adjusted by tensioning screws 10, 11, respectively. The printing plate front edge and the printing plate rear edge are also clamped in a known manner in the tensioning bars 3, 4 by clamping devices 21, 22, respectively. The front tensioning bar 3 and the rear tensioning bar 4 are disposed in a known manner on parallel guides (not shown) and are displaceable in the tangential or substantially circumferential direction.

The printing plate is fixed in the front tensioning bar 3 in known manner in a zero position, e.g., by means of locating pins.

Figure 6:
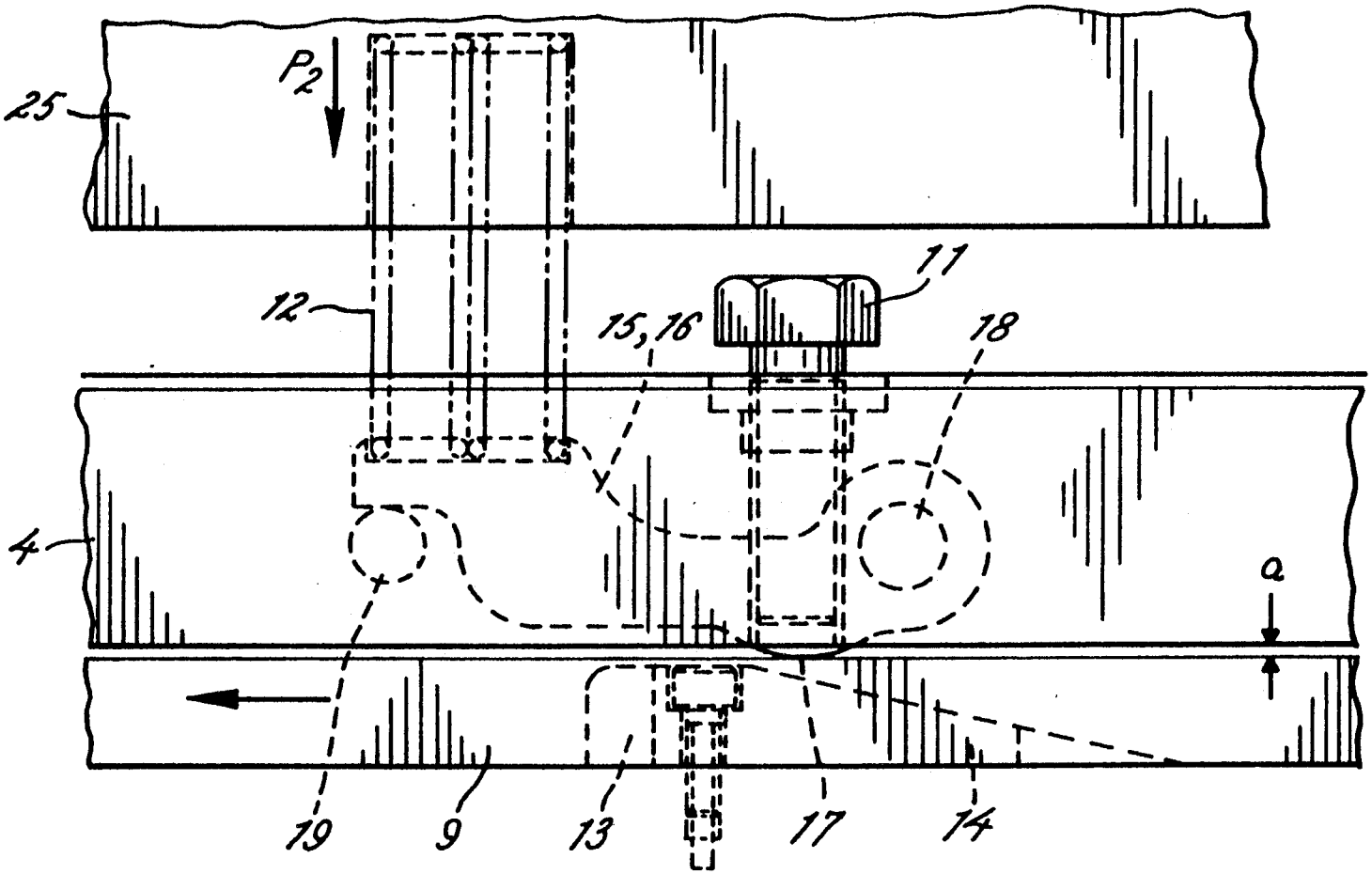
FIG. 6 is a detail of the plate tensioning device.

The quick-action tensioning device consists of a pressure strip 9 (FIGS. 4 and 6) which is disposed along the cylinder gap 2 in a recess 7 extending parallel to and behind the gap wall 8 (FIG. 3) in the plate cylinder 1, the pressure strip 9 being movable axially along the cylinder gap 2. The pressure strip 9 has two superimposed recesses 13 with an inclined plane, which slide on wedge surfaces of fixed coacting members 14 so that a parallel movement of the end portions of the pressure strip 9 is possible in the circumferential direction for quick-tensioning of the printing plate.

Figure 4:
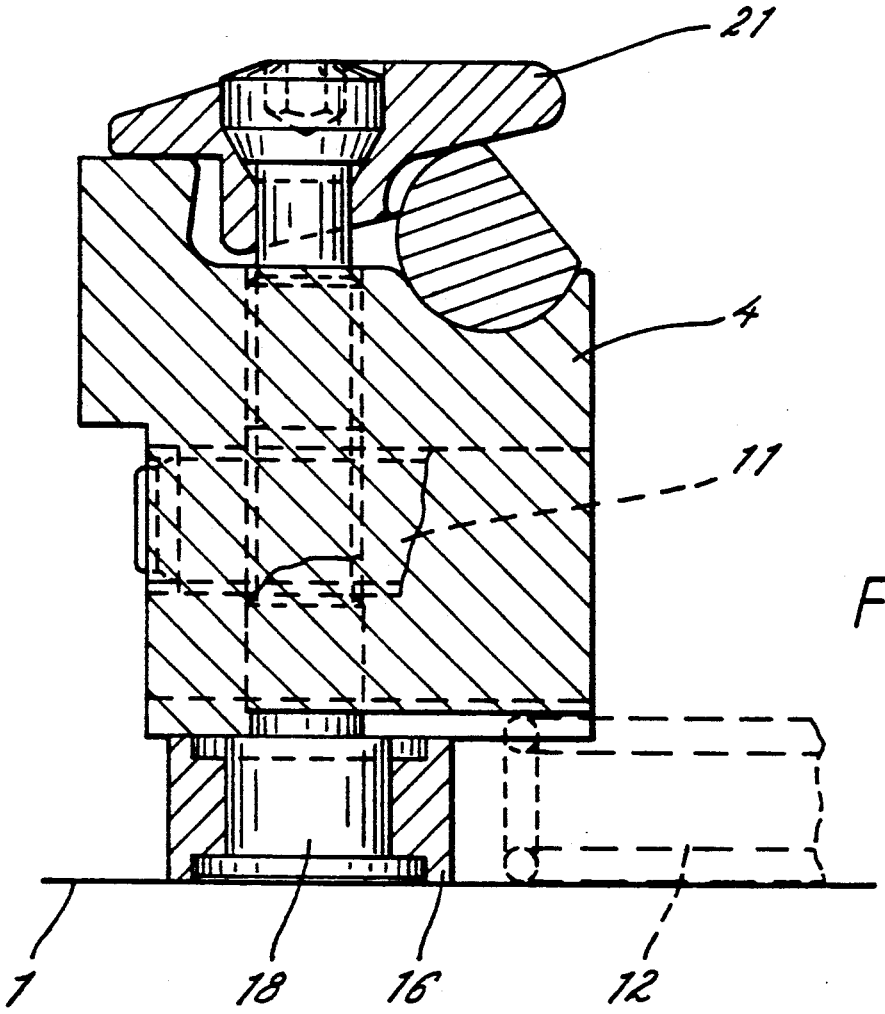
FIG. 4 is a section through the pivot point of one of the tensioning levers in the rear tensioning bar of the plate tensioning arrangement.

At least four tensioning levers 15, 16 are disposed along the bearing surface of the pressure strip 9 beneath the divided rear tensioning bar 4 and are of mirror-image symmetry with respect to one another, a tensioning lever 15 and 16 being associated with each tensioning screw 11. The mirror-image arrangement is not absolutely essential. The tensioning levers 15, 16 are supported on the pressure strip 9 via an integrally formed lug 17 with a lever transmission. One end of each of the tensioning levers 15, 16 is connected to the divided rear tensioning bar 4 by means of a swivel joint 18 (FIG. 4). The other free end of the tensioning lever 15, 16 is supported on an abutment pin 19 through the agency of a spring 12 which is supported so as to be fixed to the cylinder, said abutment pin 19 being secured on the line connecting the joints 18 in the rear tensioning bar 4. The pivoting levers 15, 16 are supported via the lugs 17 and the bottom recess 13 in the pressure strip 9 on the coacting member 14 while the tensioning screws 11 of the upper recess 13 are adapted to be supported opposite one another on the pressure strip 9.

Figure 5:
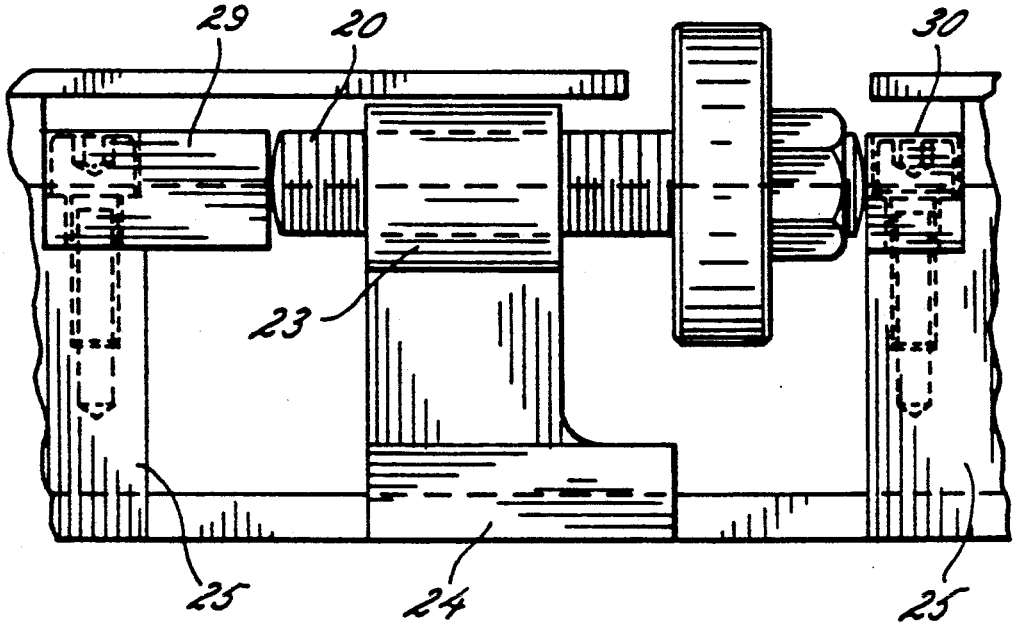
FIG. 5 shows the central actuator as a detail.

The pressure strip 9 is adapted to be actuated from a central place in the middle of the cylinder 1 by means of a rotatable spindle 20 (FIG. 5) movable in the tangential direction, said spindle being disposed in the axial direction between the front tensioning bar 3 and the rear tensioning bar 4 and either having a hexagon or knurling or a quick-action grip with a ratchet. A spindle nut 23 is axially movable on the spindle 20 and is connected rigidly to the pressure strip 9 via a bridge 24. The spherical end faces of the spindle 20 are supported on both sides in support walls 25 via unequal thrust members 29, 30 (FIG. 5) which can be exchanged for one another so that the tensioning range can be expanded by rearranging these parts and printing plates of different lengths can be uniformly tensioned.

As soon as the front end of the printing plate is clamped in the clamping device 22, the plate cylinder 1 is rotated through one revolution to apply the printing plate. The trailing end of the printing plate is then clamped in the clamping device 21.

In the first phase, the tensioning levers 15, 16 press the pressure strip 9 against the gap wall. The spring force is preset at $P_2$ in FIG. 6 and the spring travel is shown at a.

Figure 7:
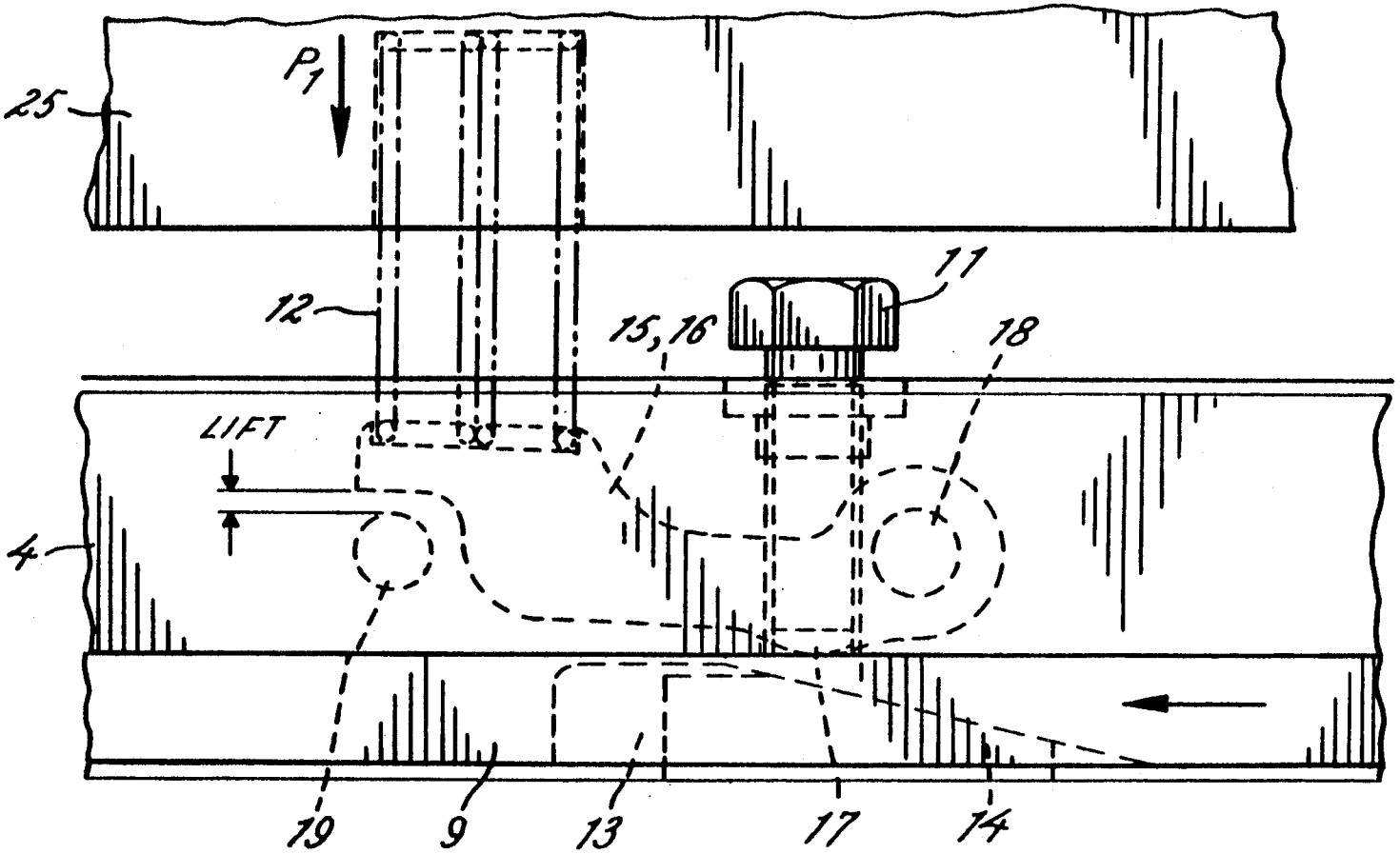
FIG. 7 is another detail of the plate tensioning device and showing the latter in a moved position.

In a final phase, shown in FIG. 7, as the pressure strip 9 moves circumferentially, the free ends of the tensioning levers 15, 16 are pivoted away from the abutment pin 19 about the joint 18 with loading of the spring 12 to $P_1$. Accordingly, uniform tensile forces are exerted circumferentially, as a result of regulation of the tension with automatic retensioning, on the divided rear tensioning bar 4 and hence on the printing plate, by the spring 12 via tensioning levers 15, 16 provided in accordance with the number of tensioning screws 11.

The spring 12 disposed tangentially is supported on the support walls 25. It may be advantageous for the support wall 25 to be movable with respect to the plate cylinder 1 so that the plate tension can be increased or reduced via the altered travel of the spring 12 bearing on the support wall.

For axial register, correction screws 27 (FIG. 1) are also provided in known manner and, in the case of the rear tensioning bar 4, bear on an arm 28 provided in the cylinder central plane while in the case of the front tensioning bar 3 they are supported externally against cylinder side walls.

Circumferential register correction is carried out in a known manner by means of the tensioning screws 11, the springs 12 relaxing in these conditions. The free ends of the tensioning levers 15, 16 bear against the abutment pin 19. The tensioning of the printing plate is effected in the correction operation by way of the tensioning screws 11, combined use of the tensioning screw 11 or tensioning springs 12 being possible depending on the correction direction. To bring the tensioning screws 11 into operation, they only have to be turned to the spacing "a" (time advantage). There is no change of clearance in the adjustment means, particularly the tensioning screws 11.

To prevent undesirable displacement of the front tensioning bar 3 in the guides (not shown), the front tensioning bar 3 is also supported at the support wall 25 by a tangentially disposed compression spring 26 (FIG. 1).

We claim:

1. An arrangement for use in a printing machine having a plate cylinder, a cylinder gap and a gap wall, said arrangement comprising a divided front printing plate tensioning bar and a divided rear printing plate tensioning bar, said bars being located in the cylinder gap and being movable substantially in the circumferential direction of the cylinder, axially spaced front tensioning screws connected to said front bar and located to bear directly on the gap wall whereby adjustment of said front screws results in substantially circumferential movement of said front bar, means for effecting quick-action tensioning by moving said rear bar substantially circumferentially, said means comprising a quick-acting mechanism for initial tensioning and comprising axially spaced rear tensioning screws for final tensioning, said quick-action tensioning mechanism comprising a pressure strip extending axially along the cylinder gap, said rear screws being connected to said rear bar and bearing against said pressure strip whereby adjustment of said rear screws results in substantially circumferential movement of said rear bar, said pressure strip being formed with recesses having inclined surfaces, axially fixed members having wedge surfaces which coact with said inclined surfaces to move said pressure strip substantially circumferentially in one direction when said pressure strip is moved axially in one direction, a central actuating device for moving said pressure strip axially back and forth, the improvement comprising a tensioning lever associated with each rear tensioning screw and located along said pressure strip beneath said rear tensioning bar, a lug integral with each lever and bearing against said pressure strip, a joint pivotally connecting one end of each lever to said rear bar, a fixed abutment pin associated with each lever, spring means fixed to said cylinder and urging the free end of each lever into bearing engagement with the respective abutment pin, movement of said pressure strip axially in said one direction by said actuating device causing the free ends of said levers to pivot away from said abutment pins and effecting loading of said spring means.

2. An arrangement as defined in claim 1 further including a support wall extending axially between said front and rear bars and supporting said spring means.

3. An arrangement as defined in claim 1 in which said central actuating device comprises a rotatable threaded spindle disposed between said bars, a nut movable along said spindle in response to rotation thereof, and means connecting said nut rigidly to said pressure strip.

4. An arrangement as defined in claim 3 further including thrust members rotatably supporting the ends of said spindle.

5. An arrangement as defined in claim 4 further including walls supporting said thrust members, said thrust members projecting axially from said walls by unequal distances.

6. An arrangement as defined in claim 5 in which said thrust members are interchangeable on said walls.

* * * * *